US005921909A

United States Patent [19]

Gustafsson

[11] Patent Number: 5,921,909

[45] Date of Patent: Jul. 13, 1999

[54] INLET DEVICE FOR A CENTRIFUGAL SEPARATOR

[75] Inventor: Bengt-Olof Gustafsson, Rönninge, Sweden

[73] Assignee: Alfa Laval AB, Lund, Sweden

[21] Appl. No.: 08/894,133

[22] PCT Filed: Feb. 12, 1996

[86] PCT No.: PCT/SE96/00169

§ 371 Date: Nov. 10, 1997

§ 102(e) Date: Nov. 10, 1997

[87] PCT Pub. No.: WO96/25234

PCT Pub. Date: Aug. 22, 1996

[30] Foreign Application Priority Data

Feb. 13, 1995 [SE] Sweden ..... 9500501

[51] Int. Cl.[6] ..... B04B 1/08; B04B 7/14

[52] U.S. Cl. ..... 494/70

[58] Field of Search ..... 494/56, 67–73

[56] References Cited

U.S. PATENT DOCUMENTS

| | | | |
|---|---|---|---|
| 1,492,168 | 4/1924 | Hapgood | 494/70 |
| 1,759,522 | 5/1930 | Schmitz | 494/70 |
| 3,482,771 | 12/1969 | Thylefors . | |
| 4,142,671 | 3/1979 | Ivin et al. . | |
| 4,193,537 | 3/1980 | Bodelson et al. | 494/70 |

FOREIGN PATENT DOCUMENTS

WO93/25314 12/1993 WIPO .

*Primary Examiner*—Charles E. Cooley
*Attorney, Agent, or Firm*—Fish & Richardson P.C.

[57] ABSTRACT

Inlet device for a centrifugal separator, which easily can be modified so that the centrifugal separator in a simple way can get a broadened range of applications. To obtain this an inlet device according to the invention is composed by a first part (11), which forms a first portion (15) of the inlet channel with an inlet (16) and an outlet (17), located radially outside this, and a second part (12), which is formed by a frusto conical flowing disc and is arranged between the outlet (17) of the first portion (15) of the inlet channel and a stack of separation discs (24) in a separation chamber (6), towards which a second part (12) delimits at least one second portion (18) of the inlet channel, which is connected to the outlet (17) of the first portion (15) of the inlet channel and opens in at least one opening (19) arranged in the flowing disc, which is located at a radial distance from the outlet of the first portion (15) of the inlet channel, and the second portion (18) of the inlet channel having a zone (20) surrounding the rotation axis, which is located radially between the outlet (17) of the first portion (15) of the inlet channel and the at least one opening (19), and essentially is out of obstacles for liquid to flow in circumferential direction relative to the inlet device.

8 Claims, 2 Drawing Sheets

INLET DEVICE FOR A CENTRIFUGAL SEPARATOR

FIELD OF THE INVENTION

The present invention concerns an inlet device for a centrifugal separator, the rotor of which is rotatable in a predetermined rotational direction around a rotation axis and delimits an inlet chamber for a liquid mixture of components, which are to be separated, and a separation chamber, which surrounds the inlet chamber and is delimited from the same by means of a first part of an inlet device, and which communicates with the inlet chamber via at least one inlet channel formed in the inlet device, the inlet channel having an opening in the separation chamber located at a predetermined distance from the rotational axis. A first portion of the inlet channel is formed in the first part of the inlet device with a radial inner inlet and an outlet located radially outside this located outlet. The rotor further delimits an outlet chamber for a component separated during operation in the separation chamber. At least one stack of frusto conical separation discs arranged at a distance from each other is placed in the separation chamber coaxially with the rotor. The separation discs form between themselves interspaces, which communicate with said inner channel via at least one distributing channel.

BACKGROUND OF THE INVENTION

A centrifugal separator, which is provided with such an inlet device is shown in U.S. Pat. No. 3,482,771.

Centrifugal separators of this kind are used for centrifugal treating of liquid mixtures of components, the difference in densities and concentrations of which in the supplied mixture vary case by case. Many details in such a centrifugal separator have to be specially designed for a relatively limited number of applications, to be able to achieve a satisfactory separation result. This means that an often very expensive part has to exist in a great number of variants. One such detail is constituted by the inlet device described above, which for the application at hand shall be so designed that the supplied liquid mixture during operation is brought to flow in a wanted manner to the opening of the inlet channel, which is located at a radial level in the separation chamber suitable for the application at hand, whereas the inlet chamber is kept filled up radially inwardly to such a level that the supplied liquid mixture can be received gently in the inlet chamber and gently be entrained in the rotation of the rotor.

SUMMARY OF THE INVENTION

The object of the present invention is to accomplish an inlet device for a centrifugal separator, which makes it possible by simple and cost saving means to be able to modify a centrifugal separator so that it can be used in a broad range of applications.

According to the present invention one accomplishes this by designing an inlet device of the kind initially described with a second part too, which is formed by a frusto conical flowing disc and is arranged on a side of the first part, which is turned towards the separation chamber, between the outlet of the first portion of the inlet channel and the stack of separation discs. The flowing disc is arranged to delimit at least one second portion of the inlet channel towards the separation chamber, which second portion is connected to the first portion of the inlet channel at the outlet of it and opens into the separation chamber via at least one opening, which is arranged in the flowing disc and located at the predetermined radial distance from the rotation axis and at a radial distance from the outlet of the first portion of the inlet channel. The second portion of the inlet channel has a zone surrounding the rotation axis, which is located radially between the outlet of the first portion of the inlet channel and said opening, and which essentially is free of obstacles for a liquid mixture present during operation in this zone to flow in a circumferential direction relative to the inlet device, the second portion of the inlet channel being so arranged that essentially all liquid mixtures of components during operation flow through the same towards the opening.

Thus, only the second part of the inlet device, which is formed by an easily modifiable conical flowing disc, possibly needs to be modified to adapt the inlet device to the application at hand.

In a preferred embodiment of the invention the first and the second parts of the inlet device are removably joined.

Suitably, the second portion of the inlet channel is delimited by the second part together with the first part and open radially outwardly towards the separation chamber to reduce the danger of clogging by heavy particles or fibers possibly contained in the supplied liquid mixture.

Radially inwardly the second portion of the inlet channel preferably is closed to avoid an unseparated mixture of components from leaking into a radially inner portion of the separation chamber and contaminating a separated specifically light component, which has been accumulated in this portion of the separation chamber.

In a special embodiment of the invention the opening of the second portion of the inlet channel is located radially outside the outlet of the first portion of the inlet channel. Seen in the rotational direction the opening of the second portion of the inlet channel is then preferably located behind the outlet of the first portion of the inlet channel.

In another embodiment of the invention the second portion of the inlet channel comprises a further zone, which is located radially between the outlet of the first portion of the inlet channel and said opening. In this zone means are arranged fixedly connected to the second part of the inlet device to entrain the liquid mixture flowing during operation into this second portion of the inlet channel in the rotation of the rotor.

Thus, one can by simple means modify the inlet device so that the flow capacity of it can be increased when needed and an even broader range of applications for the centrifugal separator can be achieved without the number of expensive details being increased.

BRIEF DESCRIPTION OF THE DRAWINGS

The invention will be described in the following more closely with reference to the attached drawings, in which FIG. 1 schematically shows an axial section through a rotor in a centrifugal separator with an inlet device according to the invention.

DETAILED DESCRIPTION

Figure 1:
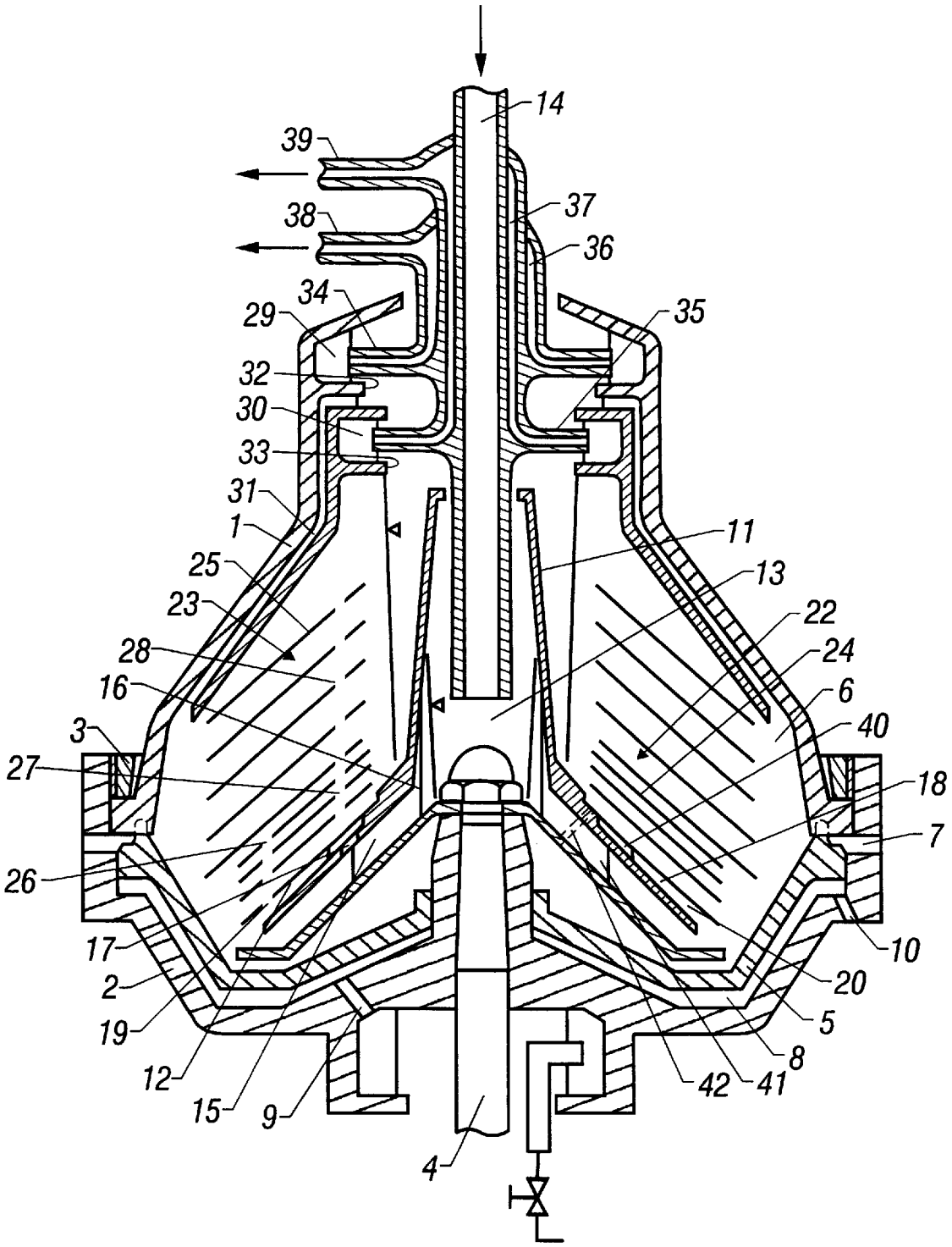

The rotor shown in FIG. 1 comprises an upper part 1 and a lower part 2, which are held together by a locking ring 3. The rotor is supported by a driving shaft 4 which is connected to the lower part 2. Inside the rotor a valve slide 5 is arranged axially movable in the lower part 2. The valve slide 5 delimits via the upper part 1 a separation chamber 6 and is arranged to open and close an annular gap at the largest periphery of the separation chamber 6 between the separation chamber 6 and the outlet opening 7 to periodically discharge a component, which during operation has been separated out of a liquid mixture supplied to the rotor and has been accumulated at the periphery of the separation chamber 6. The valve slide 5 delimits together with the lower part 2 a closing chamber 8, which is provided with an inlet 9 and a throttled outlet 10 for a closing liquid. Centrally in the rotor an inlet device is arranged, which is composed by a first part 11 and a second part 12. The first part 11 surrounds and delimits an inlet chamber 13 from the separation chamber 6. Centrally in the inlet chamber 13 a stationary inlet tube 14 is arranged. The first part 11 forms a first portion 15 of the inlet channel, which is provided with entraining wings, has a radially inner inlet 16 in the inlet chamber 13 and a radially outside this located outlet 17.

In the example shown in FIG. 1 the first portion 15 of the inlet channel is open radially outwardly via a passage under the first part 11. Thus, specific heavy particles or fibers, which possibly are contained in the supplied liquid mixture and are separated out in the first portion 15 of the first inlet channel, freely can flow radially outwardly through this passage and further out towards the radially outermost periphery of the separation chamber 6. In order not to have the main liquid flow taking place through the passage but through the outlet 17 of the first portion 15 of the inlet channel the passage surrounds the rotation axis and is essentially free of obstacles for a liquid present in the passage to flow in a circumferential direction relative to the inlet device whereby a resistance against liquid flow radially through the passage is created. However, the first portion 15 of the inlet channel can alternatively be closed radially outwardly within the scope of the present invention.

The second part 12 of the inlet device, which is formed by an easily modifiable flowing disc, is arranged on the side of the first part 11 of the inlet device, which is turned towards the separation chamber 6. The second part 12 delimits together with the first part 11 at least one second portion 18 of the inlet channel, which is connected to the first portion 15 of the inlet channel at its outlet 17 and opens in one or more openings 19 arranged in the flowing disc at the above mentioned predetermined radial distance from the rotational axis. The second part 12 of the inlet device is then preferably removably joined to the first part 11 as indicated by element 42, which can be a screw for example, but the two parts of the inlet device can also be permanently joined together.

The openings 19 shown as examples in the figure consist of holes arranged in the flowing disc but the openings 19 can also consist of the radially outer edge of the flowing disc or recesses extending radially inwardly from this radially outer edge. In the shown example the openings 19 are located radially outside the outlet 17 of the first portion 15 of the inlet channel but they can also be located radially inside the outlet 17.

Between the outlet 17 of the first portion 15 of the inlet channel and the openings 19 of the second portion of the channel, the second portion 18 of the inlet channel has a zone 20 surrounding the rotational axis, which essentially is free of obstacles for a liquid mixture present during the operation in this zone to flow in a circumferential direction relative to the inlet device and a further zone 21, which extends radially, and in which means are arranged fixedly connected to the second part of the inner device to entrain the liquid mixture flowing during operation into this second portion of the inlet channel in the rotation of the rotor.

In the example shown in FIG. 1 two stacks 22 and 23 of a number of frusto conical separation discs 24, 25 respectively, are arranged on each other inside the separation chamber 6 coaxially with the rotation axis. The separation discs in each stack are preferably identical.

The separation discs 24 in the figure shown in the lower stack 22 have holes located aligned with each other and the openings 19 of the second portion of the inlet channel, which together form a distributing channel 26 communicating with the second portion 18 of the inlet channel. The distributing channel 26 can alternatively be formed by the radially outer edge of the separation disc 24 or by recesses extending from this edge.

At a radial level at a distance from the radial level of the distributing channel 26 these separation discs 24 have holes located axially aligned with each other, which together form an outlet channel 27 for a liquid, out of which specifically heavy components have been preseparated in the lower stack 22 of the separation discs 24.

The separation discs 25 in the upper stack 23 have axially aligned with each other and with the outlet channel 27 in the first stack 22 located holes, which together form a distributing channel 28 for distributing liquid flowing out of the outlet channel 27 in the first stack 22 out into the interspaces between the separation discs 25 in the upper stack 23.

The upper part forms in the figure shown in its upper end a central outlet chamber 29 for discharge of a specifically heavy liquid component separated during operation and a central outlet chamber 30 for discharge of a specifically light liquid component separated during operation. The first mentioned outlet chamber 29 communicates with the separation chamber 6 via an outlet channel 31 formed in the upper part 1 and an overflow outlet 32. The channel 31 formed in the upper part 1 opens in a radially inner portion of the separation chamber 6. The last mentioned outlet chamber 30 communicates via an overflow outlet 33 with a central portion of the separation chamber 6.

In the two outlet chambers 29 and 30 a stationary discharge device 34 and 35, respectively, are arranged in a known manner to discharge a heavy and a light separated liquid component, respectively, through internal discharge channels 36 and 37, respectively, towards connected outlets 38 and 39, respectively.

Figure 2:
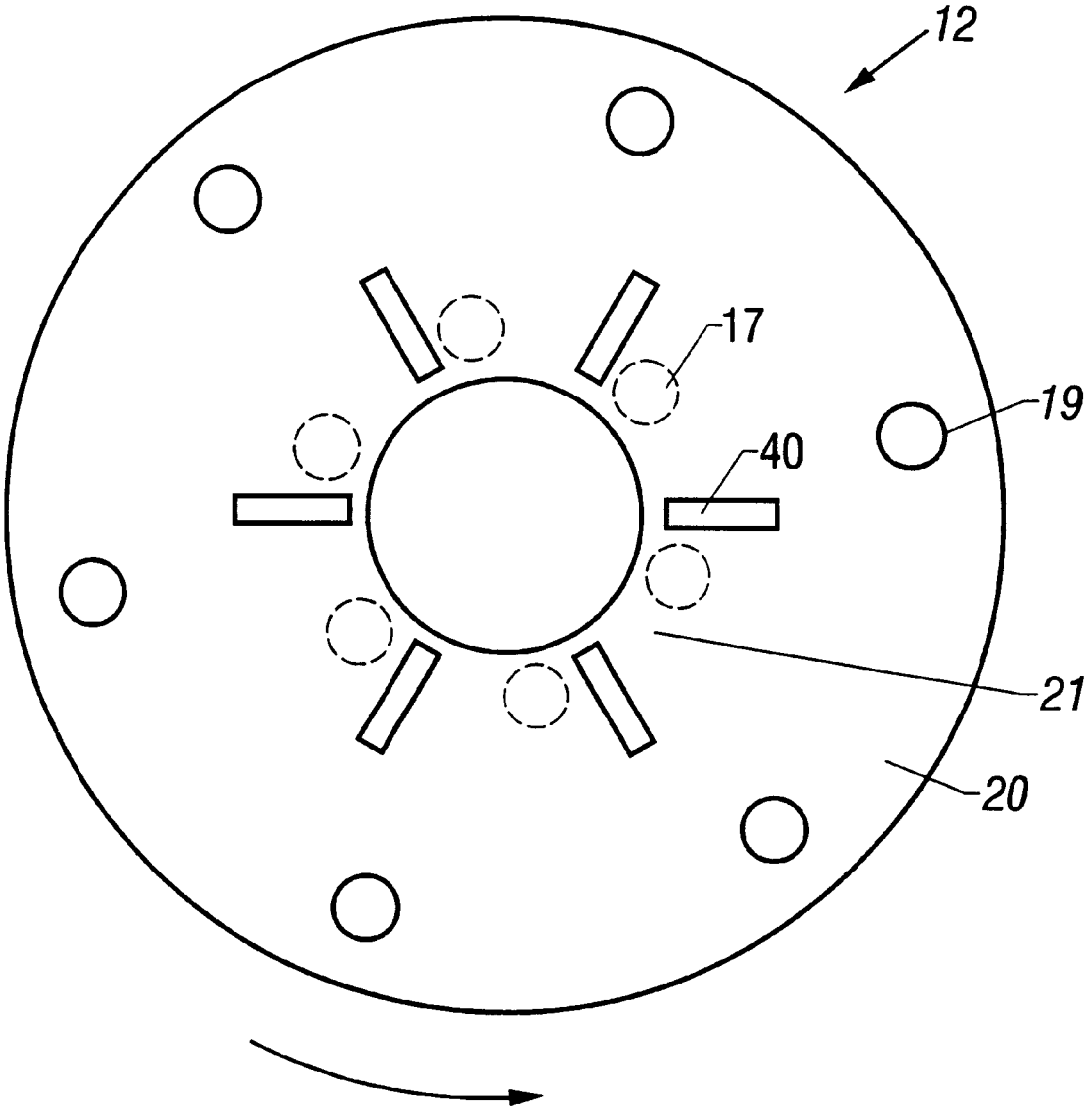
FIG. 2 shows a portion of the inlet device according to the invention in the centrifugal separator according to FIG. 1 seen from underneath.

FIG. 2 shows the second part 12 of the inlet device in the shape of a frusto conical flowing disc seen from below. An arrow shows the rotational direction of the rotor and thus the rotational direction of the flowing disc during operation.

The second part 12 on its side underneath has a number of straight elongated entraining means 40, which are equally distributed around the center of the flowing disc and extend radially through a radially inner zone 21 of a second part 12 of the inlet device. At a predetermined radial level, which in the example shown in the figure is located at a radially outer portion of the second part of the inlet device, the same is provided with holes, which form openings 19 of the second portion 18 of the inlet channel shown in FIG. 1. The position of the outlet 17 of the first portion 15 of the inlet channel shown in FIG. 1 relative to the second portion is indicated with circles, which are drawn with dotted lines. Seen in the rotational direction the openings 19 are located behind the outlet 17.

A centrifugal separator, which is designed according to the invention, functions in the following way:

Upon start of the centrifugal separator the rotor is brought to rotate and the separation chamber 6 is closed by supplying closing liquid to the closing chamber 8 through the inlet 9. Thereafter, the liquid mixture of components, which are to be centrifugally treated, is supplied to the inlet chamber 13 via the inlet tube 14.

From the inlet chamber 13 the supplied liquid flows radially outwardly through the first portion 15 of the inlet channel arranged in the first part 11 where it is entrained in the rotation of the rotor by means of wings 41 arranged on the first part 11 and via the outlet 17 further into the second portion 18 of the inlet channel arranged in the second part 12. The liquid then flows radially outwardly first through a zone 21, in which means are arranged to further entrain the liquid while flowing radially outwardly, and then to flow further radially outwardly through a zone 20 surrounding the rotation axis, which essentially is free of obstacles for a liquid mixture present during operation in this zone to flow in a circumferential direction relative to the inlet device. While flowing radially outwardly towards the opening 19 the liquid will strive to rotate with a lower angular speed than the rotor and thereby create a resistance for a flow radially through this zone.

Thus, a counter pressure can be maintained in the inlet device, which makes it possible that the inlet chamber can be kept filled up radially inwardly to a small radius and thus accomplish an inlet, which is gentle to the supplied liquid and does not diminish the possibility to a satisfying separation result at a certain flow through the centrifugal separator, without the need of decreasing the radius of other liquid levels in the centrifugal separator.

If the supplied liquid mixture contains specifically heavy particles or fibers some of them will be separated and accumulated on the under side of the second part 12 and flow radially outwardly along the same. By the fact that the second portion 18 of the inlet channel is open radially outwardly the particles or fibers separated in this way can flow further radially outwardly and be collected at the radially outermost part of the separation chamber 6 from where they can be periodically discharged through the outlet openings 7. Thus, the danger of having the centrifugal separator clogged decreases. The radially outwardly directed flow is promoted by the location of the openings 19 seen in the rotational direction behind the outlet 17. The layer of particles or fibers accumulated on the underside of the second part 12 will namely thereby be influenced by a radially outwardly directed shearing force from the flow in a so called "Ekman-layer" cooperating with the centrifugal force.

The liquid mixture, out of which particles or fibers have been separated in this manner, flows via the openings 19 further into the distributing channel 26 in the lower stack 22 of separation discs 24 and is distributed into the interspaces between these separation discs 24.

In these interspaces the liquid flows radially inwardly towards the outlet channel 27, the remaining specifically heavy particles and fibers being separated. In order to prevent liquid from flowing radially inwardly passing the outlet channel and possibly leaking over to the outlet chamber 30 for separated specific light liquid component and contaminating this component the separation discs 24 can be designed with a zone, located radially inside the outlet channel 27, which surrounds the rotational axis and is essentially free of obstacles for a liquid mixture present during operation in this zone to flow in a circumferential direction relative to the rotor. Hereby, a resistance is created against flow radially inwardly through this zone.

From the outlet channel 27 the liquid cleansed of particles or fibres flows into the distributing channel 28 in the upper stack 23 of separation discs 25 and is distributed out into the interspaces between these discs. In these interspaces the flow takes place radially outwardly while a specific light liquid component is separated from a specific heavy liquid component.

During separation the specific heavier liquid component flows radially outwardly and is accumulated in the radial outer portion of the separation chamber 6, while the specific lighter liquid component flows radially inwardly and is collected in the radially innermost portion of the separation chamber 6.

The specific heavier liquid component flows out of the separation chamber 6 through the outlet channel 31 and via the overflow outlet 32 into the outlet chamber 29. Out of the outlet chamber 29 the liquid is discharged through internal discharge channels 36 in a stationary discharge device 34 out towards an outlet 38. The separated specific lighter liquid component flows out of the separation chamber 6 via an overflow outlet 33 into the outlet chamber 30, from which it is discharged through internal discharge channels 37 in a stationary discharge device 35 towards an outlet 39.

In order to achieve a wanted separation result the flows of liquid shall be brought to take place in an intended manner in the centrifugal separator at the premises at hand in the application in question.

By designing an inlet device for a centrifugal separator according to the present invention it can by simple means be modified and adapted to the premises of the application in question.

What is claimed is:

1. An inlet device for a centrifugal separator, the rotor of which is rotatable in a predetermined rotational direction around a rotational axis and forms an inlet chamber (13) for a liquid mixture of component, which are to be separated, a separation chamber (6), which surrounds the inlet chamber (13) and is separated from the inlet chamber (13) by means of a first part (11) of the inlet device, the separation chamber communicating with the inlet chamber (13) via at least one inlet channel formed in the inlet device, the inlet channel having an opening in the separation chamber (6) located at a predetermined radial distance from the rotational axis, and a first portion of the inlet channel being formed in the first part with a radially inner inlet (16) and an outlet (17) located radially outside the inlet, and at least one outlet chamber (29, 30) for a component separated during separation in the separation chamber (6), whereby at least one stack (22) of frusto conical separation discs (24) arranged at a distance from each other is located in the separation chamber (6) coaxially with the rotor, which separation discs (24) form between themselves interspaces, which communicate with said inlet channel via at least one distributing channel (26), wherein the inlet device has a second part (12), formed by a frusto conical flowing disc and arranged on a side of the first part (11), the side being turned towards the separation chamber (6), between the outlet (17) of the first portion (15) of the inlet channel and the stack of separation discs (24), the second part (12) being arranged to define towards the separation chamber (6) at least one second portion (18) of the inlet channel, the second portion (18) of the inlet channel being connected to the first portion (15) of the inlet channel at the outlet (17) of the first portion (15), the second portion (18) opening in at least one opening (19) arranged in the flowing disc, the opening being located at said predetermined radial distance from the rotational axis and at a radial distance from the outlet (17) of the first portion (15) of the inlet channel, and said second portion (18) of the inlet channel having a zone (20) surrounding the rotational axis, the zone being located radially between the outlet (17) of the first portion (15) of the inlet channel and said opening (19), the zone being essentially obstacle-free for a liquid mixture present during operation in the zone (20) to flow in a circumferential direction relative to the inlet device, the second portion (18) of the inlet channel being so arranged that essentially all of the liquid mixture during operation flows through the second portion towards the opening (19).

2. The inlet device according to claim 1, wherein the first and the second parts (11, 12 respectively) are removably joined together.

3. The inlet device according to claim 1, wherein the second portion (12) is arranged to define together with the first part (11) the second portion (18) of the inlet channel.

4. The inlet device according to claim 1, wherein the second portion (18) of the inlet channel is open radially outwardly towards the separation chamber (6).

5. The inlet device according to claim 1, wherein the second portion (18) of the inlet channel is closed radially inwardly towards the separation chamber (6).

6. The inlet device according to claim 1, wherein the opening (19) of the second portion (18) of the inlet channel is located radially outside the outlet (17) of the first portion (15) of the inlet channel.

7. The inlet device according to claim 6, wherein the opening (19) of the second portion (18) of the inlet channel seen in the rotational direction is located behind the outlet (17) of the first portion (15) of the inlet channel.

8. The inlet device according to claim 1, wherein the second portion (18) of the inlet channel also comprises a further zone (21) located radially between the outlet (17) of the first portion (15) of the inlet channel and said opening (19) and means (40) being arranged in the further zone (21) and permanently joined to the second part (12) of the inlet device to entrain in the rotation of the rotor the liquid mixture flowing during operation into the second portion (18) of the inlet channel.

* * * * *

UNITED STATES PATENT AND TRADEMARK OFFICE

CERTIFICATE OF CORRECTION

PATENT NO. : 5,921,909

DATED : 07/13/99

INVENTOR(S) : Gustafsson

It is certified that error appears in the above-identified patent and that said Letters Patent is hereby corrected as shown below:

Col. 6, line 29, change "component" to --components--.

Col. 7, line 16, change "portion" to --part--.

Signed and Sealed this

Fourteenth Day of March, 2000

*Attest:*

Q. TODD DICKINSON

*Attesting Officer*

*Commissioner of Patents and Trademarks*